US009701139B2

(12) United States Patent
Motoyama et al.

(10) Patent No.: US 9,701,139 B2
(45) Date of Patent: Jul. 11, 2017

(54) PRINTING DEVICE AND CONTROL METHOD OF A PRINTING DEVICE

(71) Applicant: Seiko Epson Corporation, Tokyo (JP)

(72) Inventors: Hiroyuki Motoyama, Shiojiri (JP); Norio Tsuchiya, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/235,697

(22) Filed: Aug. 12, 2016

(65) Prior Publication Data

US 2017/0043596 A1 Feb. 16, 2017

(30) Foreign Application Priority Data

Aug. 13, 2015 (JP) ..... 2015-159848

(51) Int. Cl.
*B41J 11/66* (2006.01)

(52) U.S. Cl.
CPC ..... *B41J 11/663* (2013.01); *B41J 11/666* (2013.01)

(58) Field of Classification Search
CPC ..... B41J 11/663; B41J 11/70; B41J 3/4075; B41J 11/703; B41J 11/706; B41J 11/42; B41J 11/666; B41J 13/0045; B65H 2513/40
See application file for complete search history.

(56) References Cited

U.S. PATENT DOCUMENTS 5,531,530 A * 7/1996 Kuramoto ..... B26D 3/12 400/593
6,439,786 B1 * 8/2002 Hasiuk ..... B41J 11/42 400/611
8,616,794 B2 12/2013 Kan et al.

FOREIGN PATENT DOCUMENTS

JP 2006-264215 A 10/2006
JP 2010-188567 A 9/2010
JP 2011-079215 A 4/2011

* cited by examiner

*Primary Examiner* — Thinh H Nguyen
(74) *Attorney, Agent, or Firm* — Nutter McClennen & Fish LLP; John J. Penny, Jr.

(57) ABSTRACT

A printer that partially cuts roll paper to leave an uncut portion prevents paper jams from reversing the roll paper. A printer 1 has a print unit 41 for printing images on roll paper R; a cutter unit 46 disposed downstream in the conveyance direction from the print unit for cutting the roll paper and leaving an uncut portion; a conveyance unit 42 for conveying the roll paper in the conveyance direction or a reverse direction that is the opposite of the conveyance direction; and a controller 40 that executes a reversing process conveying the roll paper in reverse by the conveyance unit 42 when the roll paper is separated from the paper roll at the uncut portion after the cutter unit 46 cuts the roll paper, and not executing the reversing process in specific circumstances in which the roll paper remains connected through the uncut portion.

11 Claims, 10 Drawing Sheets

PRINTING DEVICE AND CONTROL METHOD OF A PRINTING DEVICE

Priority is claimed under 35 U.S.C. §119 to Japanese Application no. 2015-159848 filed on Aug. 13, 2015, which is hereby incorporated by reference in their entirety.

BACKGROUND

1. Technical Field

The present disclosure relates to a printing device and a control method of a printing device.

2. Related Art

Printing devices (printers) that have a print unit and a cutting unit (cutter), and convey roll paper in reverse of the normal conveyance direction to reposition the paper after cutting the roll paper (recording paper) with the cutter are known from the literature. See, for example, JP-A-2011-079215. In addition to positioning the paper, conveying the roll paper in reverse after cutting with the cutter is also used in this type of printer to reduce the size of the top margin resulting from the distance between the printing position of the print unit and the cutting position of the cutter.

Some printers only partially cut the roll paper to leave an uncut connector. If the roll paper is reversed as described in JP-A-2011-079215 in this type of printer without first tearing off the cut portion of the roll paper after the roll paper is cut, the portion that was cut may catch in the paper path and cause a paper jam. A process preventing such paper jams is therefore required.

SUMMARY

An objective of the present disclosure is to prevent paper jams resulting from reversing roll paper in a printing device that partially cuts roll paper.

To achieve the foregoing objective, a printing device able to store roll paper according to the disclosure has a print mechanism that prints images on the roll paper; a cutter disposed downstream in the conveyance direction from the print mechanism and configured to partially cut the roll paper and leave an uncut portion; a conveyance mechanism that conveys the roll paper in the conveyance direction or a reverse direction that is the opposite of the conveyance direction; and a controller that executes a reversing process conveying the roll paper in the reverse direction by the conveyance mechanism if the roll paper is separated from the roll paper at the uncut portion after the roll paper is cut by the cutter, and not executing the reversing process in a specific situation in which the roll paper may remain partially connected through the uncut portion.

This aspect of the disclosure prevents paper jams resulting from conveyance in the reverse direction in a printer that cuts the roll paper to leave an uncut portion.

A printing device according to another aspect of the disclosure also has a communicator that receives control commands instructing printing by the print mechanism and cutting by the cutter; the specific situation being a situation other than when the controller causes the print mechanism to print images and the cutter to cut the roll paper based on the control commands received by the communicator.

This aspect of the disclosure reliably prevents the reversing process from executing while roll paper is still connected through the uncut portion, and prevents paper jams.

A printing device according to another aspect of the disclosure also has a cover that opens and closes the opening to a storage compartment holding the roll paper, and a cover detection sensor that detects the cover. The controller executes an automatic cutting process to cut the roll paper by the cutter after conveying the roll paper in the conveyance direction by the conveyance mechanism when the cover detection sensor detects that the cover closed; and the specific situation is that the cover detection sensor detects that the cover closed and the automatic cutting process was executed by the controller after a specific event occurred.

This configuration reliably prevents the reversing process from executing while roll paper is still connected through the uncut portion, and prevents paper jams.

A printing device according to another aspect of the disclosure also has a paper detector that detects the roll paper; and the specific event is the paper detector detecting there is no roll paper during conveyance by the conveyance mechanism.

This configuration reliably prevents the reversing process from executing while roll paper is still connected through the uncut portion, and prevents paper jams.

In a printing device according to another aspect of the disclosure, the conveyance mechanism is configured to convey the roll paper by holding the roll paper between a thermal head and a platen roller; and the specific event is the cover detection sensor detecting the cover is open during conveyance by the conveyance mechanism.

This configuration reliably prevents the reversing process from executing while roll paper is still connected through the uncut portion, and prevents paper jams.

A printing device according to another aspect of the disclosure also has a communicator configured to receive control commands instructing printing by the print mechanism and cutting by the cutter; and the specific situation is that other unprocessed control commands are stored in volatile memory when the controller prints images by the print mechanism and then cuts the roll paper by the cutter based on one control command.

This configuration reliably prevents the reversing process from executing while roll paper is still connected through the uncut portion, and prevents paper jams.

Another aspect of the disclosure is a control method of a printing device that is able to store roll paper and has a print mechanism that prints images on the roll paper, a cutter disposed downstream in the conveyance direction from the print mechanism and cutting the roll paper while leaving an uncut portion, and a conveyance mechanism that conveys the roll paper in the conveyance direction or a reverse direction that is the opposite of the conveyance direction; the control method including executing a reversing process of conveying the roll paper in the reverse direction by the conveyance mechanism if the roll paper is separated from the roll paper at the uncut portion after the roll paper is cut by the cutter, and not executing the reversing process in a specific situation in which the roll paper may remain partially connected through the uncut portion.

This aspect of the disclosure prevents paper jams resulting from conveyance in the reverse direction in a printer that cuts the roll paper to leave an uncut portion.

Other objects and attainments together with a fuller understanding of the disclosure will become apparent and appreciated by referring to the following description and claims taken in conjunction with the accompanying drawings.

DESCRIPTION OF EMBODIMENTS

A preferred embodiment of the present disclosure is described below with reference to the accompanying figures.

Figure 1:
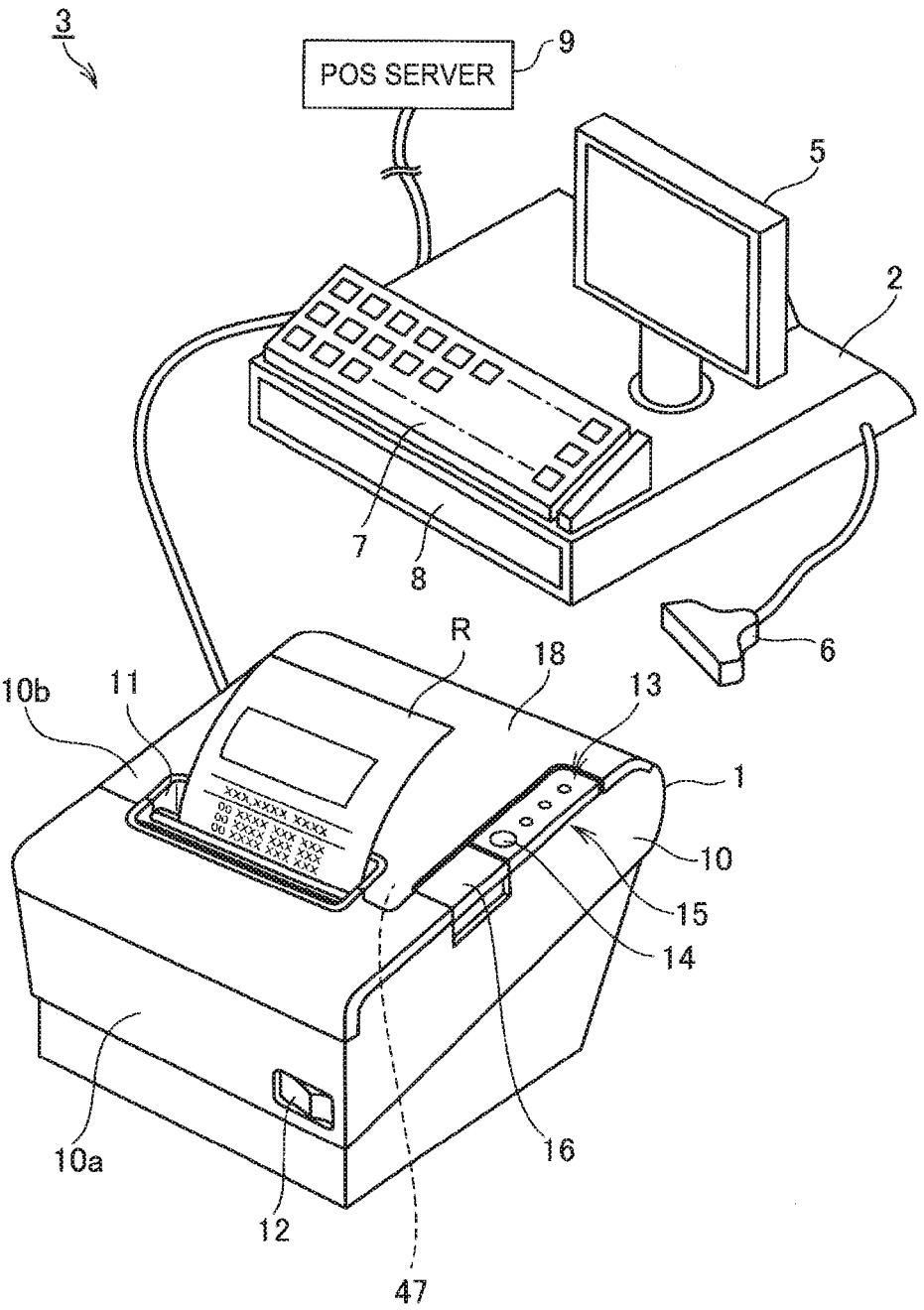
FIG. 1 illustrates a POS terminal according to a preferred embodiment of the disclosure.

FIG. 1 illustrates the configuration of a POS terminal 3 according to a preferred embodiment of the disclosure.

The POS terminal 3 is installed at the checkout counter in a retail store such as a supermarket or convenience store, or in a restaurant or bar, for example, and produces sales receipts.

As shown in FIG. 1, the POS terminal 3 includes a host computer 2 that runs a transaction process for each sale, and a printer 1 that connects to the host computer 2 and produces receipts as controlled by the host computer 2.

As shown in FIG. 1, the host computer 2 has a display for displaying transaction-related information, a barcode scanner 6 for reading barcodes on products or product packaging, a keyboard 7 with various keys, and a cash drawer 8 for storing money. A POS server 9 that stores a product master relating product code, price, and other information for each product, and a customer master storing customer-related information, connects to the host computer 2.

To produce a receipt, the host computer 2 appropriately accesses the POS server 9 and acquires the information needed to produce a receipt based on input from the barcode scanner 6 and keyboard 7. Next, the host computer 2 generates and sends to the printer 1 control commands instructing executing processes related to producing a receipt. The printer 1 then produces a receipt based on the control commands received from the host computer 2.

As shown in FIG. 1, the printer 1 has a box-like case 10.

Inside the case 10 is a compartment 20 (FIG. 2) for storing a roll of roll paper R.

A power switch 12 for turning the printer 1 power on/off is disposed to the front 10*a* of the case 10.

A paper exit 11 from which the roll paper R stored in the compartment 20 of the printer 1 is discharged is disposed in the top 10*b* of the case 10.

Figure 2:
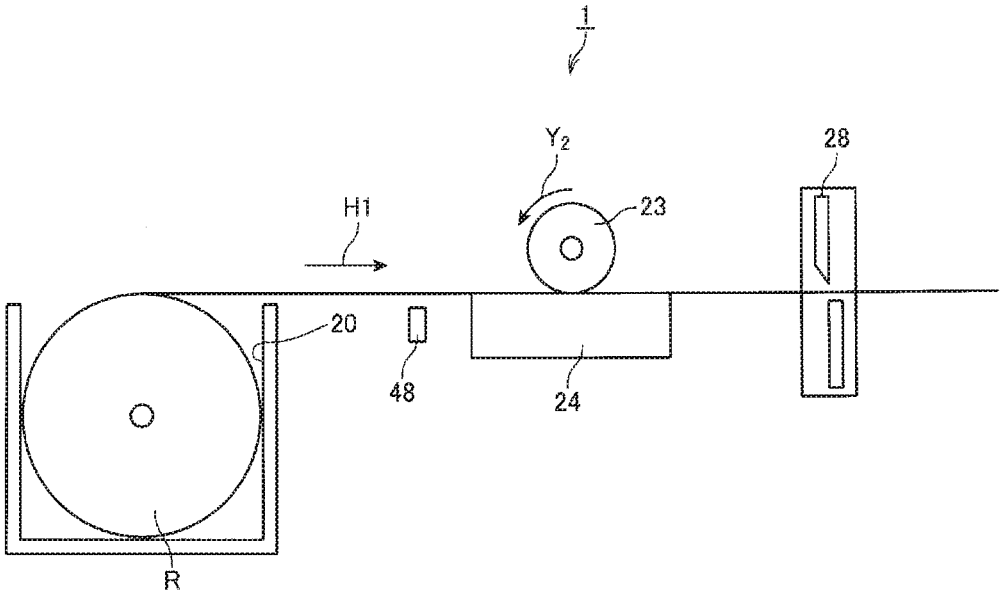
FIG. 2 illustrates the internal configuration of a printer.

A panel 13 is also disposed on the top 10*b* of the case 10. A push-button automatic feed switch 14 that commands conveying the roll paper R is included in the panel 13. While the feed switch 14 is depressed, the roll paper R is automatically conveyed in the conveyance direction H1 (FIG. 2). An LED display unit 15 is also disposed to the panel 13. The LED display unit 15 has multiple LEDs, and the operating mode of the printer 1, errors, and other information related to the printer 1 are indicated by driving the LEDs on/off in specific patterns.

Near the panel 13 is a lever 16 for opening the cover 18. Depressing the lever 16 when the cover 18 is closed releases and allows the cover 18 to open from the closed position.

The cover 18 is a member that opens and closes the opening for loading and removing roll paper R in the storage compartment 20 inside the case 10.

FIG. 2 schematically describes the internal configuration of the printer 1.

Below, the rolled portion of the roll paper R housed in the storage compartment 20 is referred to as the paper roll, and the portion that has been pulled off the paper roll is referred to as the conveyed roll paper.

In the printer 1, the conveyed roll paper is unrolled and conveyed in the conveyance direction H1 from the paper roll stored in the storage compartment 20. As shown in FIG. 2, downstream in the conveyance direction H1 from the storage compartment 20 are a platen roller 23 and opposing thermal head 24. The platen roller 23 holds the conveyed roll paper with the thermal head 24 and rotates in the direction of arrow Y2 to convey the conveyed roll paper in the conveyance direction H1. The thermal head 24 forms dots by means of heat elements and prints images on the conveyed roll paper as the paper is conveyed in the conveyance direction H1.

As also shown in FIG. 2, a cutter unit 28 is disposed downstream in the conveyance direction H1 from the platen roller 23 and thermal head 24. The cutter unit 28 moves a movable knife in related to a fixed knife and cuts the conveyed roll paper by these knives crossing.

The cutter unit 28 in this embodiment of the disclosure does not make a full cut completely cutting the roll paper R, and instead makes a partial cut that leaves an uncut portion R1 (FIG. 3) in the roll paper R.

Figure 3:
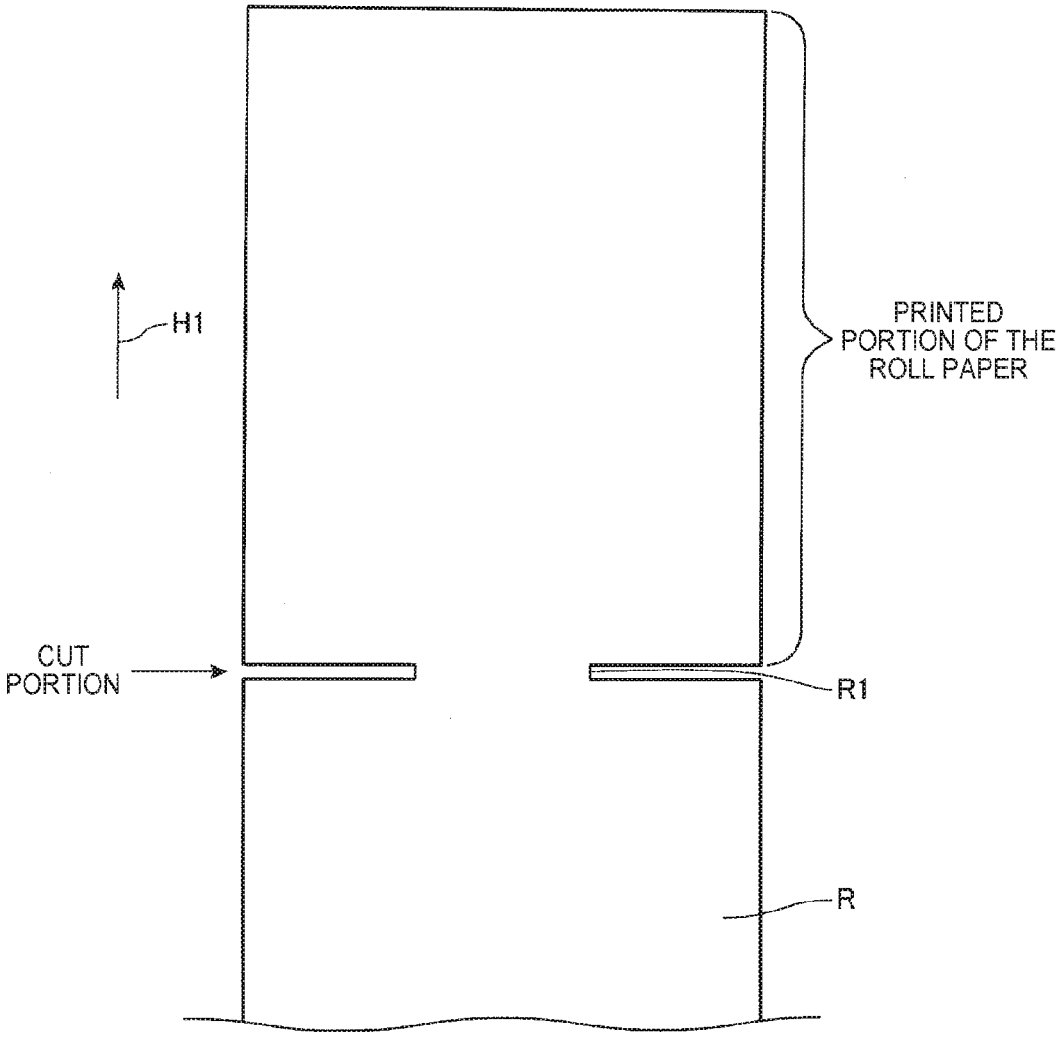
FIG. 3 illustrates a partial cut.

FIG. 3 shows the cut portion of the roll paper R cut by the cutter unit 28.

As shown in FIG. 3, when the roll paper R is cut by the cutter unit 28, the roll paper R is not completely cut, and instead is cut leaving an uncut portion R1. Even after the roll paper R is cut by the cutter unit 28, the roll paper R on the case 10 side of the uncut portion R1 (the upstream side in the conveyance direction H1), and the roll paper R (referred to below as the printed portion of the roll paper) on the opposite side of the case 10 as the uncut portion R1 (the downstream side in the conveyance direction H1), remain partially connected by the uncut portion R1. As a result, when the roll paper R is cut by the cutter unit 28 to produce a receipt, the receipt (printed portion of the roll paper) will not fall out of the paper exit 11, the risk of losing the receipt is decreased, and the uncut portion R1 can be easily torn off and given to the customer.

Note that the form of the uncut portion R1 is not limited to the example shown in FIG. 3.

Figure 4:
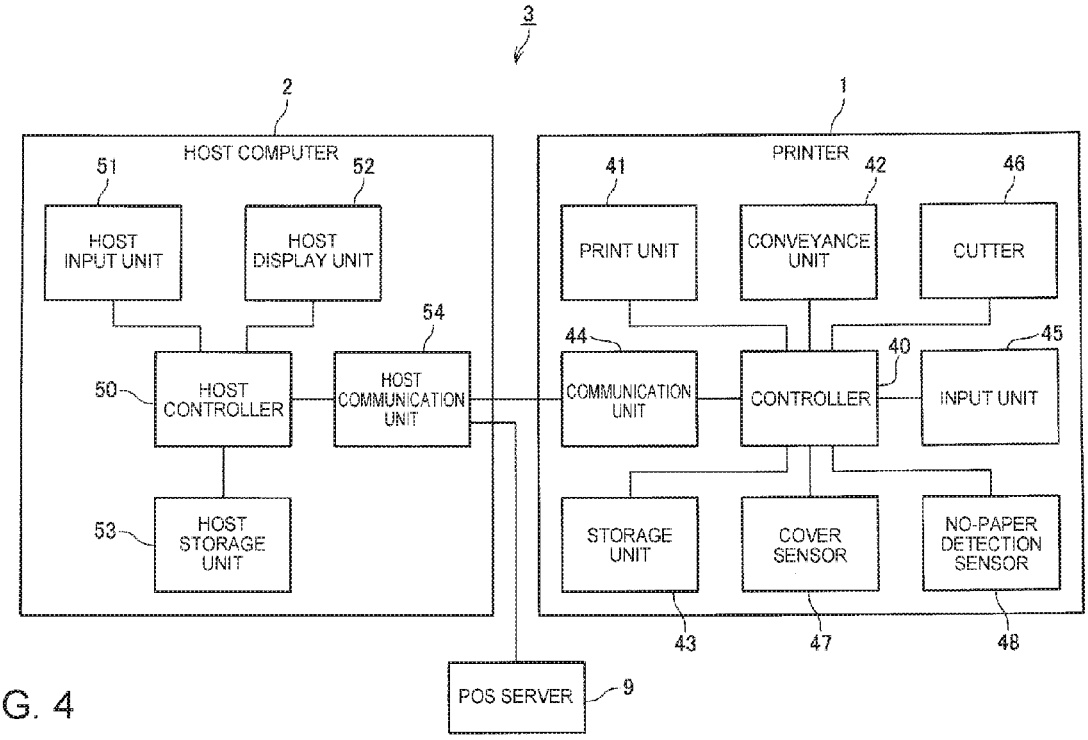
FIG. 4 is a block diagram of the functional configuration of the printer and host computer.

FIG. 4 is a block diagram illustrating the functional configuration of the printer 1 and the host computer 2 that controls the printer 1.

As shown in FIG. 4, the printer 1 has a controller 40, print unit 41 (print mechanism), conveyance unit 42 (conveyance mechanism), storage unit 43, communication unit 44 (communicator), input unit 45 (switch), cutter 46, cover sensor 47 (cover detector), and no-paper detection sensor 48 (paper detector).

The controller 40 comprises a CPU, ROM, RAM (volatile memory), and other peripheral circuits, and controls the printer 1 by the CPU reading and running a control program, for example.

The print unit 41 includes the thermal head 24, a drive circuit that drives the thermal head 24, and other mechanism related to printing on roll paper, and prints images on the roll paper R as controlled by the controller 40.

The conveyance unit 42 includes the platen roller 23, a conveyance motor that drives the platen roller 23, a motor driver that drives the conveyance motor, and other mechanism related to conveying the roll paper R, and conveys the roll paper R as controlled by the controller 40.

The storage unit 43 is EEPROM or other nonvolatile memory, and stores data. The storage unit 43 also stores a configuration file.

The communication unit 44 includes a communication module compatible with a communication protocol such as USB or RS-232, and other mechanisms related to communicating with other external devices (host computer 2), and communicates according to a specific communication protocol as controlled by the controller 40. Note that communication with external devices may be by wire or wirelessly. Received control commands and data are temporarily stored in RAM.

The input unit 45 is connected to the power switch 12, feed switch 14, and other operating switches, detects operation of the operating switches, and outputs to the controller 40. The controller 40 executes processes corresponding to the operation of the operating switches based on input from the input unit 45.

The cutter 46 includes the cutter unit 28, a cutter motor that moves the movable knife of the cutter unit 28, a motor driver that drives the cutter motor, and other mechanisms related to cutting the roll paper R, and cuts the roll paper Ras controlled by the controller 40.

The cover sensor 47 is a sensor that outputs a different value depending on whether the cover 18 is open or closed. If the cover 18 is open, the cover sensor 47 outputs a signal value indicating that the cover 18 is open to the controller 40, and if the cover 18 is closed, outputs a signal value indicating that the cover 18 is closed to the controller 40. The controller 40 detects if the cover 18 is open or closed based on the value input from the cover sensor 47.

The no-paper detection sensor 48 detects if roll paper is present. The no-paper detection sensor 48 detecting there is no roll paper R is referred to below as a no-paper state. The no-paper detection sensor 48 outputs a different signal value to the controller 40 depending on whether or not there is roll paper. The no-paper detection sensor 48 outputs a different value according to whether or not the amount of roll paper R in the storage compartment 20 exceeds a specific amount indicating that the roll paper R is near the no-paper state. The amount of roll paper R left being less than this specific value is considered a no-paper state. If the amount of roll paper R left exceeds this specific amount, the no-paper detection sensor 48 outputs a signal of a value indicating that the remaining amount of roll paper R exceeds the specific amount to the controller 40, and if the amount of roll paper R left does not exceed this specific amount, the no-paper detection sensor 48 outputs a signal of a value indicating that the remaining amount of roll paper R does not exceed the specific amount to the controller 40. Based on the value input from the no-paper detection sensor 48, the controller 40 detects whether or not there is no paper.

As shown in FIG. 4, the host computer 2 has a host controller 50, host input unit 51, host display unit 52, host storage unit 53, and host communication unit 54 (host communicator).

The host controller 50 includes a CPU, ROM, RAM, and other peripheral circuits, and controls the host computer 2 by the CPU reading and running a control program, for example.

The host input unit 51 includes input means such as a barcode scanner 6, keyboard 7, and operating switches on the host computer 2, detects input from the input means, and outputs to the controller 40. The controller 40 executes processes corresponding to the input from the input means based on the input from the host input unit 51.

The host display unit 52 includes a display 5, and displays images on the display 5 as controlled by the host controller 50.

The unit host storage unit 53 has nonvolatile memory, and stores data.

The host communication unit 54 communicates with the printer 1 according to a specific communication protocol as controlled by the host controller 50. The host communication unit 54 communicates with the POS server 9 according to a specific communication protocol as controlled by the host controller 50.

Operation of the printer 1 is described next.

Figure 5A:
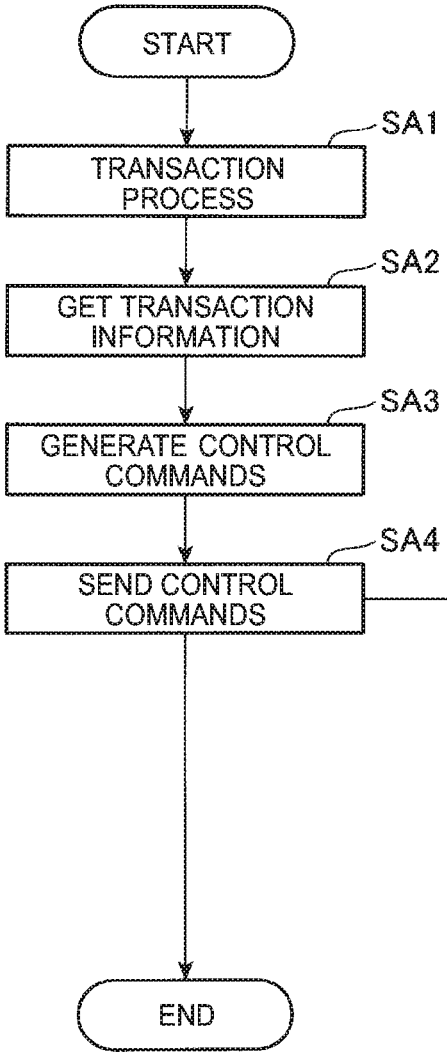
FIGS. 5A and 5B are flow charts of the operation of the host computer and printer.
Figure 5B:
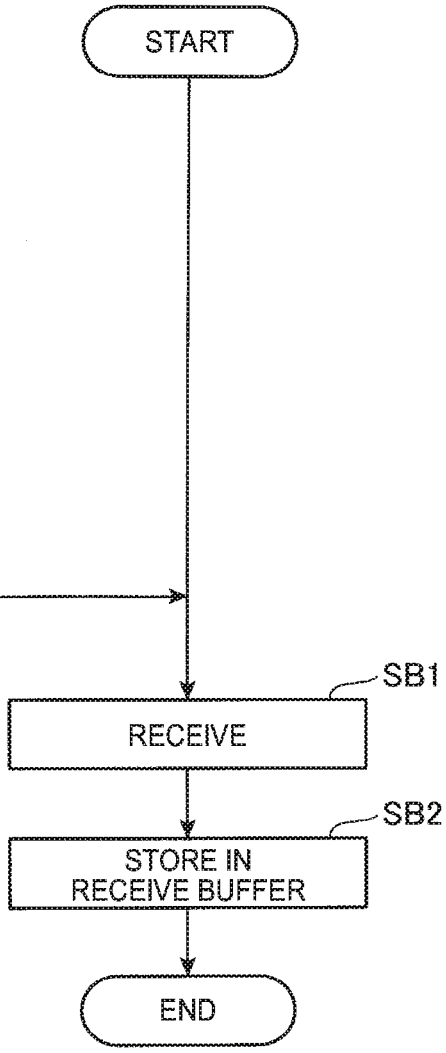

FIG. 5 is a flow chart of the operation of the host computer 2 when producing a receipt for a transaction together with the operation of the printer 1. FIG. 5A shows the operation of the host computer 2, and FIG. 5B shows the operation of the printer 1.

As shown in FIG. 5A, the host controller 50 of the host computer 2 executes a transaction process during a transaction at the checkout counter (step SA1).

More specifically, the checkout clerk at the checkout counter reads the barcode from each product purchased by the customer in the transaction with the barcode scanner 6. The product code for the corresponding product is recorded in the barcode. The host input unit 51 outputs data indicating the product code based on the result of reading with the barcode scanner 6 to the host controller 50, and the host controller 50 acquires the product code of the product based on the data input from the host input unit 51.

The host controller 50 appropriately accesses the POS server 9, and based on the acquired product code acquires the product price, name, and other product-related information. Based on the acquired product-related information, the host controller 50 executes processes of displaying the transaction-related information on the display 5 and calculating the transaction total.

When reading the barcodes of all products is completed, the checkout clerk uses the keyboard 7 to enter the transaction, receive payment from the customer, and return change to the customer, for example. The host controller 50 appropriately displays the total of the products purchased by the customer, the amount received from the customer, and the amount of change due to the customer on the display 5. The host controller 50 also appropriately controls the cash drawer 8 to open the tray of the cash drawer 8. When making change for the customer is completed, the checkout clerk operates the keyboard 7 to finalize the transaction. This completes the transaction process.

When the transaction process ends, the host controller 50 acquires the transaction information (step SA2).

The transaction information is information including the information printed on the receipt, such as identification information uniquely assigned to each transaction; information indicating the combination of product code, product name, price, and quantity for each product purchased by the customer; information indicating the total purchase amount; information indicating the amount received from the customer; information indicating the amount of change returned to the customer; and information indicating the time of the transaction.

Next, the host controller 50 generates control commands instructing producing a receipt (referred to below as receipt production control commands) based on the acquired transaction information (step SA3).

The receipt production control commands are control commands in the command language of the printer 1, and instruct issuing a receipt printed with information including the transaction information in a specific layout.

Next, the host controller 50 controls the host communication unit 54 to send the generated receipt production control commands to the printer 1 (step SA4).

As shown in FIG. 5B, the controller 40 of the printer 1 controls the communication unit 44 to receive the receipt production control commands (step SB1).

Next, the controller 40 stores the received receipt production control commands in a receive buffer (RAM, volatile memory) (step SB2).

The host computer 2 executes the transaction process as described above each time a transaction is made, and sends receipt production control commands instructing producing a receipt to the printer 1.

The printer 1 sequentially stores the receipt production control commands received from the host computer 2 in the receive buffer.

Figure 6:
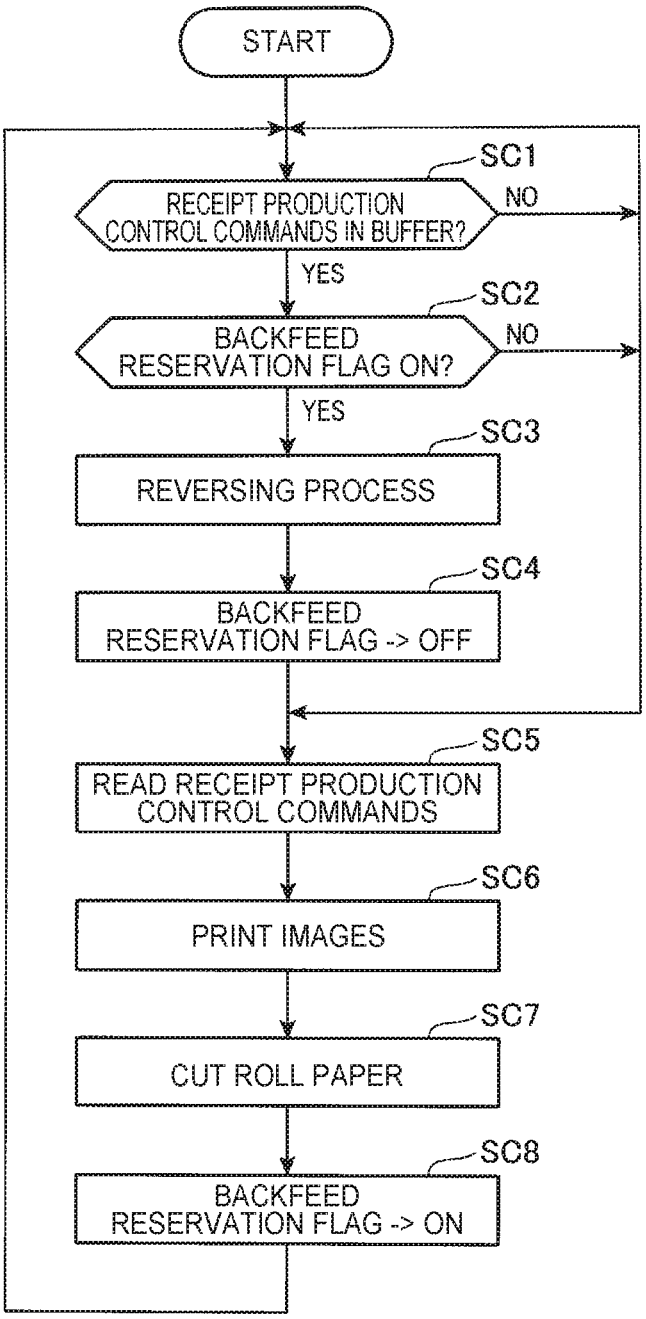
FIG. 6 is a flow chart of the operation of the printer.

FIG. 6 is a flow chart of the operation of the printer 1 when producing a receipt.

As shown in FIG. 6, the controller 40 of the printer 1 monitors if there are any receipt production control commands that have not been processed in the receive buffer (step SC1).

There will be unprocessed receipt production control commands in the receive buffer if a receipt based on the receipt production control commands has not been produced after the receipt production control commands are stored in the receive buffer as described above.

If unprocessed receipt production control commands are in the receive buffer (step SC1: YES), the controller 40 determines if a backfeed reservation flag is on (step SC2).

The backfeed reservation flag is a flag used for determining whether to execute the reversing process before printing an image (producing a receipt). The backfeed reservation flag is on if the reversing process is to be executed, and is off if the reversing process is not to be executed. As will be understood below, the backfeed reservation flag is off if the roll paper R has been cut by the cutter 46, but the printed portion of the roll paper (FIG. 3) has not been torn off and may still be connected to the roll paper R by the uncut portion R1.

If the backfeed reservation flag is on (step SC2: YES), the controller 40 executes the reversing process (step SC3). This process is described below.

FIG. 7 is used to describe the reversing process.

In FIG. 7 position T1 indicates the position where dots are formed by the thermal head 24 (the position of the heat elements), and position T2 indicates the position where the roll paper R is cut by the cutter unit 28 (the location of the knives). As described above, the cutter unit 28 is downstream in the conveyance direction H1 from the thermal head 24, and position T2 is therefore downstream in the conveyance direction H1 from position T1.

Figure 7A:
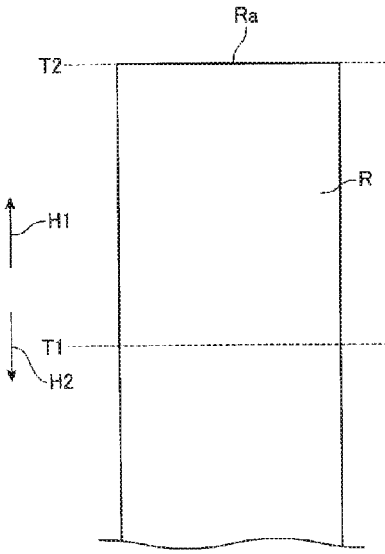
FIGS. 7A-7C describe the reverse conveyance process.
Figure 7B:
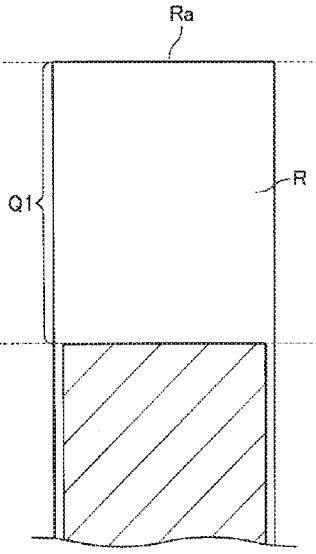
Figure 7C:
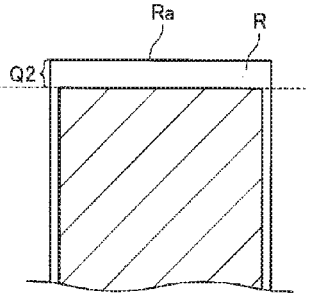
Figure 7C:
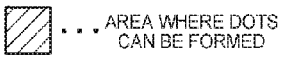

As will be understood below, if the backfeed reservation flag is on, the user has torn off the printed portion of the roll paper after the last time the roll paper R was cut by the cutter 46. Therefore, when the reversing process starts in step SC3, the relationship between the roll paper R, position T1, and position T2 is as shown in FIG. 7A. More specifically, the leading end Ra of the roll paper R is at position T2.

If image printing starts from the position shown in FIG. 7A, the area where dots are formed on the roll paper R will be on the reverse direction H2, which is the opposite of the conveyance direction H1, side of position T1. In this event, a top margin of at least length Q1 results from the difference between the thermal head 24 (position T1) and the cutter unit 28 (position T2).

The reversing process is a process that is executed to reduce the top margin that results from the distance between the thermal head 24 (position T1) and the cutter unit 28 (position T2). More specifically, the reversing process conveys the roll paper R a specific distance in reverse direction H2 from the position shown in FIG. 7A to the position shown in FIG. 7C where the leading end Ra of the roll paper R is on the conveyance direction H1 side of the position T1. As a result, the top margin is reduced at least to a margin of length Q2.

By reducing the top margin, roll paper R can be saved and cost can be reduced by saving roll paper R.

In the reversing process of step SC3, the controller 40 controls the conveyance unit 42 to convey the roll paper R a specific distance in the reverse direction H2.

After the reversing process, the controller 40 turns the backfeed reservation flag off (step SC4), and control goes to step SC5.

However, if in step SC2 the backfeed reservation flag is off (step SC2: NO), the controller 40 goes directly to step SC5. In this event, the reversing process is not executed before starting the process of producing a receipt based on the receipt production control commands.

As described above, the backfeed reservation flag is a flag that is off when the printed portion of the roll paper (FIG. 3) has not been torn off after the roll paper R is cut with the cutter 46 and remains connected to the roll paper R through the uncut portion R1. The reversing process is therefore not executed in this embodiment when the printed portion of the roll paper may still be connected through the uncut portion R1. This has the following effect. Specifically, if the roll paper R is conveyed on the reverse direction H2 while the printed portion of the roll paper is connected through the uncut portion R1, the printed portion of the roll paper will contact the paper exit 11, cutter unit 28, and other members along the conveyance path, and the roll paper R may become jammed. By not executing the reversing process when the printed portion of the roll paper is connected through the uncut portion R1, the roll paper R can be prevented from becoming jammed.

In step SC5, the controller 40 reads the receipt production control commands stored in the receive buffer.

Next, the controller 40 controls the print unit 41, conveyance unit 42, and other mechanism related to printing based on the receipt production control commands that were read, and prints receipt-related images on the roll paper R while conveying the roll paper R in the conveyance direction H1 (step SC6).

After printing the receipt-related images, the controller 40 cuts the roll paper R with the cutter 46 based on the receipt production control commands that were read (step SC7). The roll paper R is cut while leaving an uncut portion R1 as described above.

When the roll paper R is cut, the user (in this example, the checkout clerk) tears the issued receipt (the printed portion of the roll paper) from the roll paper R stored in the printer 1. The receipt is given to the customer that purchased the products in the transaction. The checkout clerk therefore tears off the receipt and hands it to the customer soon after the roll paper R is cut.

During the time until the next receipt is produced, the same checkout clerk normally reads the barcodes of products a customer purchases with the barcode scanner 6. Because the checkout clerk can simply pull off the issued receipt during this time, there is plenty of time. Because the receipt is normally given to the customer, a printed receipt is normally removed before the next receipt is issued.

Next, the controller 40 turns the backfeed reservation flag on (step SC8). After step SC8, the controller 40 returns to step SC1.

In another example, if other unprocessed receipt production control commands have already been stored in the receive buffer at the time producing a receipt based on one set of receipt production control commands is completed, there is no need for the reversing process to execute before printing a receipt based on the unprocessed receipt production control commands. The reason for this is described next.

Specifically if other unprocessed receipt production control commands have already been stored in the receive buffer at the time producing a receipt based on one set of receipt production control commands is completed, printing a receipt based on the unprocessed receipt production control commands starts soon after producing a receipt based on the first set of receipt production control commands is completed. Therefore, the time between when producing a receipt based on a first set of receipt production control commands ends and when producing the next receipt based on the unprocessed receipt production control commands starts is short. Because this time is short, the user (checkout clerk) may have not been able to tear off the receipt (printed portion of the roll paper) before producing the next receipt based on the unprocessed receipt production control commands starts after producing a receipt based on a first set of receipt production control commands ends.

As described above, however, each transaction involves reading barcodes, inputting information related to the transaction, and exchanging money between the checkout clerk and customer. The time between when the host computer 2 sends receipt production control commands based on one transaction, and when the host computer 2 sends receipt production control commands based on the transaction following the first transaction, is therefore much longer than the time required for the process of producing a receipt based on the receipt production control commands. As a result, it is rare in actual practice that unprocessed receipt production control commands will be stored in the receive buffer in step SC8.

Next, the operation of the printer 1 when producing a receipt based on receipt production control commands (during printing by the print unit 41 and paper conveyance by the conveyance unit 42) is described next.

Figure 8:
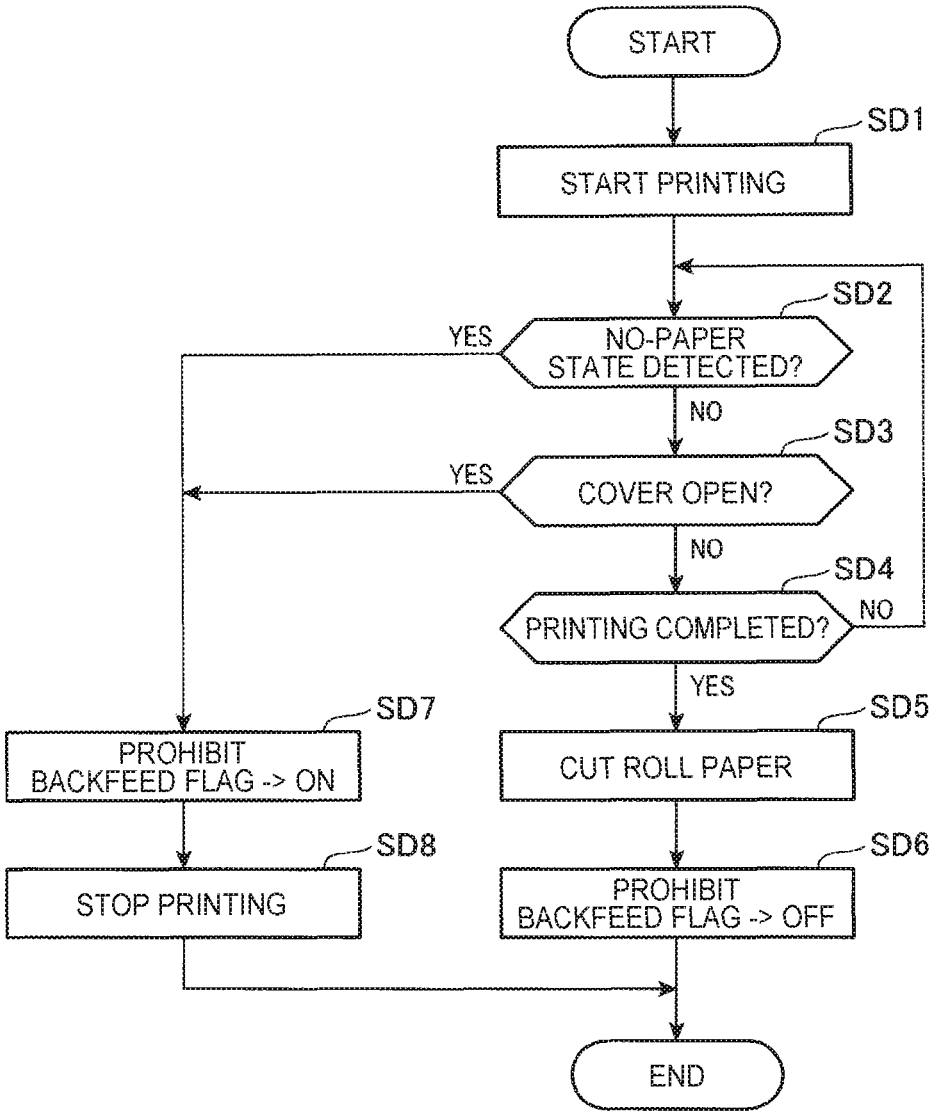
FIG. 8 is a flow chart of the operation of the printer.

FIG. 8 is a flow chart of the operation of the printer 1.

As shown in FIG. 8, the controller 40 of the printer 1 starts printing receipt-related images and conveying the roll paper R in conjunction with printing based on the receipt production control commands read from the receive buffer (step SD1).

After starting printing (after starting conveyance for printing), the controller 40 monitors if printing images based on the receipt production control commands has ended (step SD4) while monitoring if a no-paper state has occurred (step SD2), and if the cover 18 is open (step SD3). In step SD2, the controller 40 monitors if a no-paper state has occurred based on input from the no-paper detection sensor 48. In step SD3, the controller 40 monitors if the cover 18 has moved from closed to open based on input from the cover sensor 47.

If the cover 18 has moved from closed to open in this embodiment, the roll paper R is released by the thermal head 24 and platen roller 23. Printing images on the roll paper R is therefore not possible if the cover 18 is open. Printing is also disabled by the no-paper detection sensor 48 if a no-paper state occurs.

If a no-paper state is not detected (step SD2: NO), the cover 18 has not opened (step SD3: NO), and image printing has been completed (step SD4: YES), the controller 40 cuts the roll paper R based on the receipt production control commands (step SD5).

Next, the controller 40 turns a prohibit backfeed flag off (step SD6).

As will be understood below, a prohibit backfeed flag is a flag for determining whether to turn the backfeed reservation flag on or off after the automatic cutting process, which executes automatically when the cover 18 goes from open to closed. If the prohibit backfeed flag is on, the backfeed reservation flag is turned off, and if the prohibit backfeed flag is off, the backfeed reservation flag is turned on.

The controller 40 ends the process after step SD6.

If a no-paper state is detected (step SD2: YES) or the cover 18 opens (step SD3: YES) before image printing is completed (step SD4: NO), the controller 40 sets the prohibit backfeed flag on (step SD7).

Next, the controller 40 stops printing based on the receipt production control commands (stops conveyance in conjunction with printing) (step SD8), and ends the process. This is because printing (conveyance) cannot continue if a no-paper state occurs while printing (during conveyance), or if the cover 18 opens while printing.

The operation of the printer 1 when the cover 18 moves from open to closed is described next.

Figure 9:
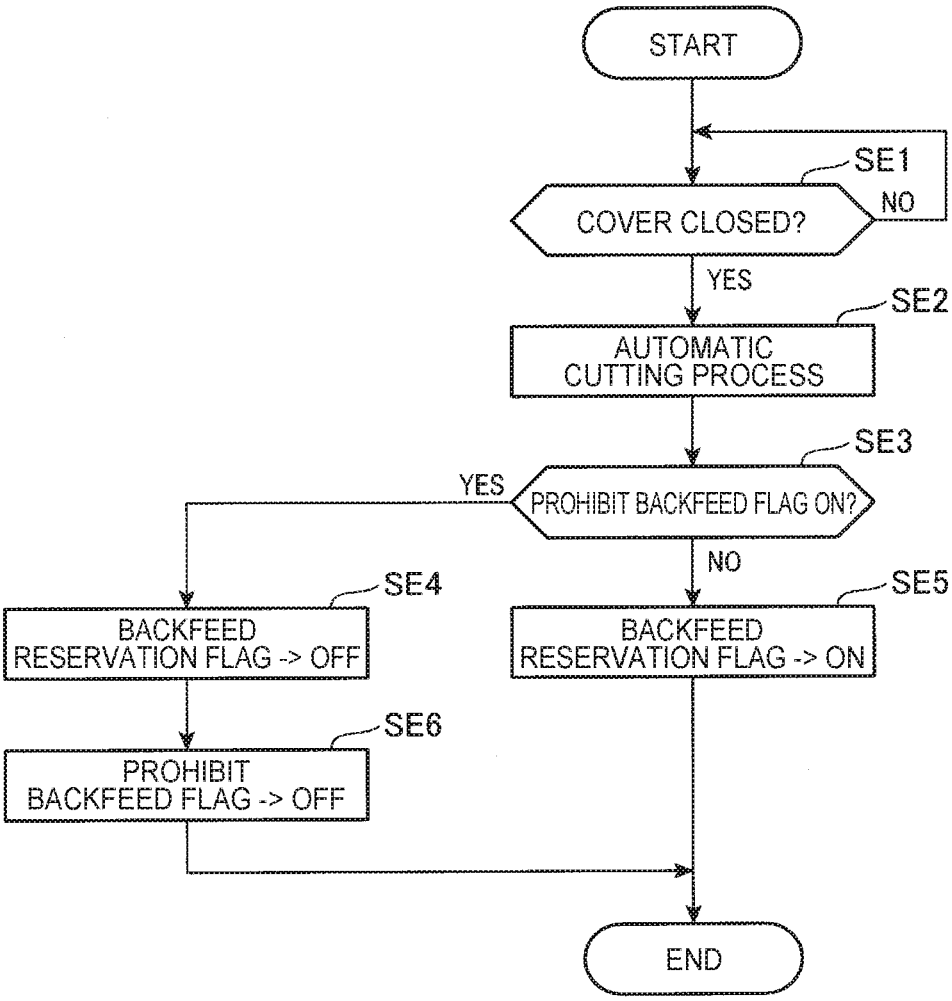
FIG. 9 is a flow chart of the operation of the printer.

FIG. 9 is a flow chart of the operation of the printer 1 when the cover 18 moves from open to closed.

As shown in FIG. 9, based on input from the cover sensor 47, the controller 40 of the printer 1 determines if the cover 18 moved from open to closed (step SE1).

If movement of the cover 18 from open to closed is detected (step SE1: YES), the controller 40 executes the automatic cutting process (step SE2).

In the automatic cutting process of step SE2, the controller 40 causes the conveyance unit 42 to convey the roll paper R in the conveyance direction H1 a distance sufficient for the leading end Ra of the roll paper R to pass the cutting position of the cutter unit 28 in the conveyance direction H1, and then cuts the roll paper R with the cutter 46. This automatic cutting process is an example of an indexing (positioning) process.

The automatic cutting process of step SE2 executes automatically when the cover 18 closes. As a result, for example, if the roll paper R is replaced while the cover 18 is open and the cover 18 is then closed, the automatic cutting process executes and image printing can start from an appropriate position in relation to the leading end Ra of the roll paper R.

Next, the controller 40 determines if the prohibit backfeed flag is on (step SE3).

If the prohibit backfeed flag is on (step SE3: YES), the controller 40 sets the backfeed reservation flag off (step SE4). Next, the controller 40 turns the prohibit backfeed flag off (step SE6), and ends the process. In this case, the next time a receipt is produced based on the receipt production control commands, the backfeed reservation flag is off and the reversing process does not execute.

However, if the prohibit backfeed flag is off (step SE3: NO), the controller 40 sets the backfeed reservation flag on (step SE5). Next, the controller 40 ends the process. In this case, the next time a receipt is produced based on the receipt production control commands, the backfeed reservation flag is ib and the reversing process executes.

The reason for step SE3, step SE4, and step SE5 is described next.

If the prohibit backfeed flag is on at the start of step SE3, the printer 1 is in one of the following states. Specifically, either a no-paper state was detected while producing a receipt (during printing and during conveyance for printing) and receipt printing stopped, the cover 18 then opened, the roll paper R was replaced, and the cover 18 closed again; or the cover 18 opened while producing a receipt (during printing and during conveyance for printing) and receipt printing stopped, and the cover 18 closed again.

In either event, because the receipt that was being printed is not completed, printing the receipt is expected to continue after the cover 18 closes. This is because a normal receipt must be given to the customer. Note that the host computer 2 has a function for sending the receipt production control commands to reprint a receipt to the printer 1 when reprinting a receipt is commanded. Because the receipt is reprinted immediately after the cover 18 closes, the time between the automatic cutting process executed by the cover 18 closing and the start of reprinting the receipt is short. As a result, after the roll paper R is cut by the automatic cutting process, reprinting the receipt may start without the user (checkout clerk) tearing off the printed portion of the roll paper produced by the automatic cutting process.

If the prohibit backfeed flag is on, the backfeed reservation flag is therefore off. This prevents the reversing process from executing when a receipt is reprinted after the cover 18 closes, and prevents paper jams.

As described above, a printer 1 according to this embodiment has a print unit 41 for printing on roll paper R; a cutter 46 disposed downstream in the conveyance direction H1 from the print unit 41 for cutting the roll paper R and leaving an uncut portion R1; a conveyance unit 42 for conveying the roll paper R in the conveyance direction H1 or a reverse direction H2 that is the opposite of the conveyance direction H1; and a controller 40 that executes a reversing process conveying the roll paper R in the reverse direction H2 by the conveyance unit 42 after cutting the roll paper R with the cutter 46, and not executing the reversing process in specific circumstances in which the roll paper R may remain partially connected through the uncut portion R1.

This configuration prevents paper jams resulting from conveyance in the reverse direction H2 in a printer 1 that cuts the roll paper R and leaves an uncut portion R1.

Furthermore, when the controller 40 detects that the cover 18 closed, it executes an automatic cutting process of conveying the roll paper R in the conveyance direction H1 by means of the conveyance unit 42, and then cutting the roll paper R with the cutter 46. If the roll paper R decreases to a no-paper state while printing with the print unit 41, printing stops, the cover 18 is then detected to close and the automatic cutting process executes, the controller 40 does not execute the reversing process before next starting to print.

This configuration reliably prevents the reversing process from executing while the printed portion of the roll paper is still connected, and prevents paper jams.

If the cover 18 opens while printing with the print unit 41, printing stops, the cover 18 closing is then detected, and the automatic cutting process executes, the controller 40 does not execute the reversing process before next starting to print.

This configuration reliably prevents the reversing process from executing while the printed portion of the roll paper is still connected, and prevents paper jams.

In addition, if an image is printed by the print unit 41 based on receipt production control commands (control commands) for one receipt, and unprocessed receipt production control commands for another receipt are already buffered when the roll paper R is cut by the cutter 46, the controller 40 does not execute the reversing process before printing based on the unprocessed receipt production control commands for another receipt.

This configuration reliably prevents the reversing process from executing while the printed portion of the roll paper is still connected, and prevents paper jams.

Other Examples

Another example is described below.

The printer 1 in the first embodiment described above is configured to not execute the reversing process if unprocessed receipt production control commands for another receipt are already stored in the receive buffer when processing based on the receipt production control commands for one receipt ends, or if printing stops (conveyance stops) due to specific reasons while printing, the cover 18 then closes and the automatic cutting process is then executed.

In another example, however, the printer 1 may execute the following process instead of the processes shown in FIG. 6, FIG. 8, and FIG. 9.

Figure 10:
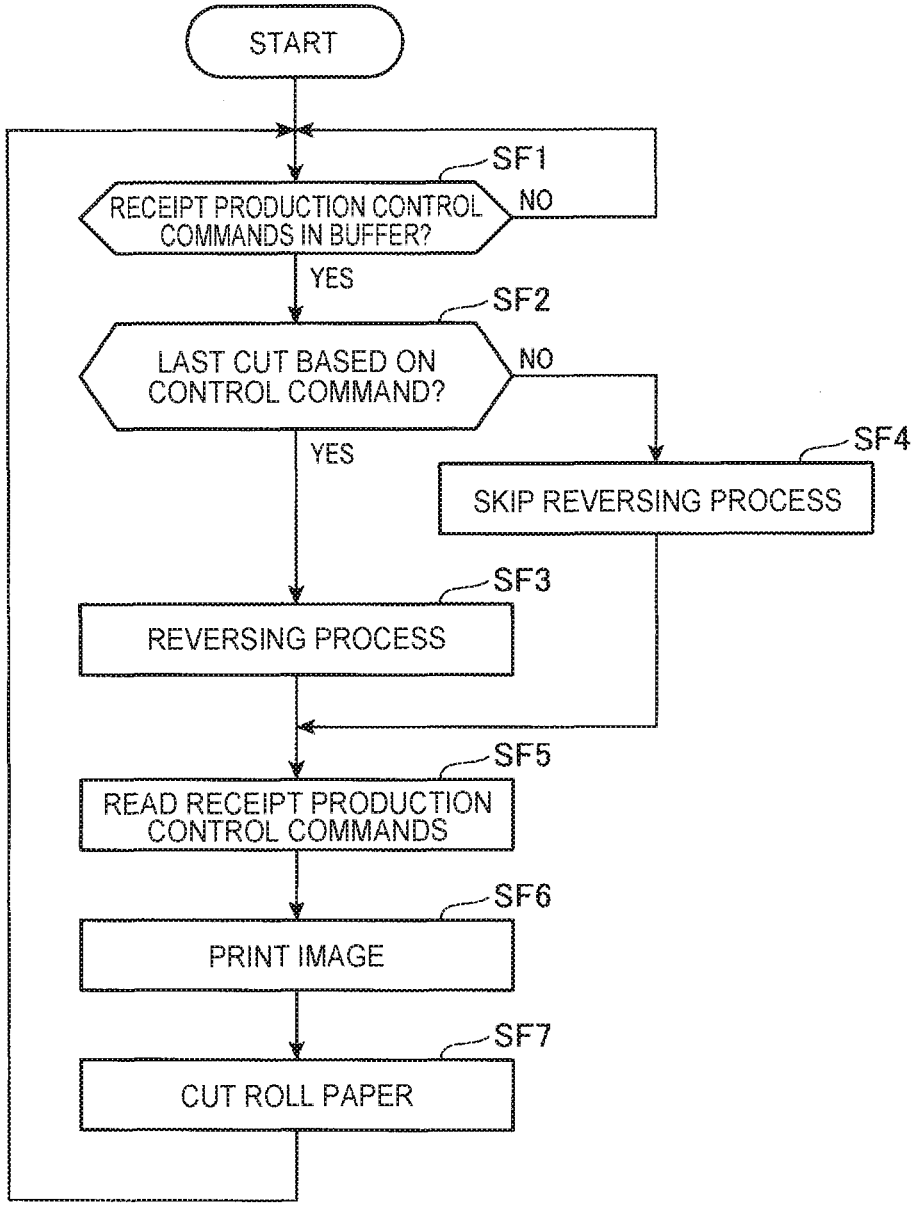
FIG. 10 is a flow chart of the operation of the printer.

FIG. 10 is a flow chart of the operation of the printer 1 in this example.

As shown in FIG. 10, the controller 40 of the printer 1 monitors if unprocessed receipt production control commands are stored in the receive buffer (step SF1).

If unprocessed receipt production control commands are stored in the receive buffer (step SF1: YES), the controller 40 determines if the last time the roll paper R was cut was based on a control command received from the host computer 2 (step SF2).

As described above, the controller 40 causes cutting the roll paper R at least when a control command (a receipt production control commands in the above example) is received from the host computer 2, and when the automatic cutting process is executed in conjunction with the cover 18 closing. The controller 40 may also cause cutting the roll paper R at other times, such as when a self-diagnostic test is run (a process of printing information related to the printer 1, such as the operating mode and firmware version, to roll paper R and then cutting the roll paper R in response to a user command).

If the last time the roll paper R was cut was in response to a control command received from the host computer 2 (step SF2: YES), the controller 40 executes the reversing process (step SF3). Next, the controller 40 goes to step SF5.

If the last time the roll paper R was cut was not in response to a control command received from the host computer 2 (step SF2: NO), the controller 40 goes to step SF5 without executing the reversing process (step SF4).

This example thus executes the reversing process when cutting is based on a receipt production control command (control command) received from the host computer 2, and otherwise does not execute the reversing process. The reason for this is described next.

Specifically, when the roll paper R is cut based on a receipt production control commands, the checkout clerk tears off the receipt (printed portion of the roll paper) after cutting to give the receipt to the customer. As a result, the printed portion of the roll paper is not connected to the roll paper R when the reversing process starts. Otherwise, the printed portion of the roll paper may still be connected to the roll paper R, and by not executing the cutting process, processing is simplified, ease of development is improved, and processing efficiency is good.

In step SF5, the controller 40 reads the receipt production control commands stored in the receive buffer.

Next, the controller 40 controls the print unit 41, conveyance unit 42, and other mechanism related to printing based on the receipt production control commands that were read, and prints receipt-related images on the roll paper R while conveying the roll paper R in the conveyance direction H1 (step SF6).

After printing the receipt-related images, the controller 40 cuts the roll paper R with the cutter 46 based on the receipt production control commands that were read (step SF7). Next, the controller 40 returns to step SF1.

The disclosure is described above with reference to a preferred embodiment thereof, but the disclosure is not limited thereto and can be modified and adapted in many ways without departing from the scope of the accompanying claims.

For example, the printer 1 is described as a device for printing receipts, but the device of the disclosure is not limited to devices that produce receipts. More specifically, the disclosure can be applied to devices with functions for printing on roll paper R, and cutting the roll paper R to leave an uncut portion R1.

The function blocks described with reference to the figures can be desirably embodied by hardware and software, and do not suggest a specific hardware configuration.

The disclosure being thus described, it will be obvious that it may be varied in many ways. Such variations are not to be regarded as a departure from the spirit and scope of the disclosure, and all such modifications as would be obvious to one skilled in the art are intended to be included within the scope of the following claims.

What is claimed is:

1. A printing device able to store roll paper, comprising:
- a print mechanism that prints images on the roll paper;
- a cutter disposed downstream in the conveyance direction from the print mechanism and configured to cut the roll paper while leaving an uncut portion;
- a conveyance mechanism that conveys the roll paper in the conveyance direction or a reverse direction that is the opposite of the conveyance direction; and
- a controller that executes a reversing process conveying the roll paper in the reverse direction by the conveyance mechanism if the roll paper is separated from the roll paper at the uncut portion after the roll paper is cut by the cutter, and does not execute the reversing process in a specific situation in which the roll paper may remain partially connected through the uncut portion.

2. The printing device described in claim 1, further comprising:
- a communicator that receives control commands instructing printing by the print mechanism and cutting by the cutter;
- the specific situation being a situation other than when the controller causes the print mechanism to print images and the cutter to cut the roll paper based on the control commands received by the communicator.

3. The printing device described in claim 1, further comprising:
- a cover that opens and closes the opening to a storage compartment holding the roll paper, and
- a cover detection sensor that detects the cover;
- the controller executing an automatic cutting process to cut the roll paper by the cutter after conveying the roll paper in the conveyance direction by the conveyance mechanism when the cover detection sensor detects that the cover closed; and
- the specific situation being the cover detection sensor detecting that the cover closed and the automatic cutting process was executed by the controller after a specific event occurred.

4. The printing device described in claim 3, further comprising:
- a paper detector that detects the roll paper;
- the specific event being the paper detector detecting there is no roll paper during conveyance by the conveyance mechanism.

5. The printing device described in claim 3,
- the conveyance mechanism configured to convey the roll paper by holding the roll paper between a thermal head and a platen roller; and
- the specific event being the cover detection sensor detecting the cover is open during conveyance by the conveyance mechanism.

6. The printing device described in claim 1, further comprising:
- a communicator configured to receive control commands instructing printing by the print mechanism and cutting by the cutter;
- the specific situation being other unprocessed control commands being stored in volatile memory when the controller prints images by the print mechanism and then cuts the roll paper by the cutter based on one control command.

7. A control method of a printing device that is able to store roll paper and has a print mechanism that prints images on the roll paper, a cutter disposed downstream in the conveyance direction from the print mechanism and configured to cut the roll paper while leaving an uncut portion, and a conveyance mechanism that conveys the roll paper in the conveyance direction or a reverse direction that is the opposite of the conveyance direction;
- the control method comprising executing a reversing process of conveying the roll paper in the reverse direction by the conveyance mechanism if the roll paper is separated from the roll paper at the uncut portion after the roll paper is cut by the cutter, and
- not executing the reversing process in a specific situation in which the roll paper may remain partially connected through the uncut portion.

8. The control method of a printing device described in claim 7,
- the specific situation being a situation other than when the print mechanism prints an image and the cutter cuts the roll paper based on a received control command.

9. The control method of a printing device described in claim 7,
- the specific situation being detecting that a cover configured to open and close the opening to a storage compartment holding the roll paper closed, the conveyance mechanism conveying the roll paper in the conveyance direction, and an automatic cutting process in which the cutter cuts the roll paper executing after a specific event occurred.

10. The control method of a printing device described in claim 9, the specific event being detecting there is no roll paper during conveyance by the conveyance mechanism.

11. The control method of a printing device described in claim 9, the specific event being sensor detecting the cover is open during conveyance by the conveyance mechanism.

* * * * *